US008012910B2

(12) United States Patent
Awano et al.

(10) Patent No.: US 8,012,910 B2
(45) Date of Patent: Sep. 6, 2011

(54) PRINTING METHOD USING THERMAL DIFFUSION TRANSFER, AND IMAGE FORMED OBJECT

(75) Inventors: Kazutoshi Awano, Tokyo-to (JP); Satoshi Narita, Tokyo-to (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 0 days.

(21) Appl. No.: 12/585,660

(22) Filed: Sep. 21, 2009

(65) Prior Publication Data

US 2010/0015366 A1 Jan. 21, 2010

Related U.S. Application Data

(63) Continuation of application No. 11/482,713, filed on Jul. 10, 2006, now Pat. No. 7,638,461, which is a continuation-in-part of application No. 10/812,414, filed on Mar. 30, 2004, now abandoned.

(30) Foreign Application Priority Data

Mar. 31, 2003 (JP) ..... 2003-095645
Mar. 31, 2003 (JP) ..... 2003-095709

(51) Int. Cl.
*B41M 5/035* (2006.01)
*B41M 5/50* (2006.01)

(52) U.S. Cl. ..... 503/227; 8/471

(58) Field of Classification Search ..... None
See application file for complete search history.

(56) References Cited

U.S. PATENT DOCUMENTS

| | | | |
|---|---|---|---|
| 6,368,684 | B1 | 4/2002 | Onishi et al. |
| 6,828,274 | B2 | 12/2004 | Onishi et al. |
| 7,005,166 | B2 | 2/2006 | Narita et al. |

FOREIGN PATENT DOCUMENTS

| | | |
|---|---|---|
| JP | A-2000-071632 | 3/2000 |
| JP | A-2000-168243 | 6/2000 |
| JP | A-2000-211255 | 8/2000 |
| JP | A-2000-326619 | 11/2000 |
| JP | A-2001-080221 | 3/2001 |
| JP | A-2002-052844 | 2/2002 |
| JP | A-2003-001944 | 1/2003 |
| JP | A-2004-299274 | 10/2004 |

OTHER PUBLICATIONS

Japanese Patent Office, Notification of Reason for Rejection mailed Dec. 8, 2009 in Japanese Patent Application No. 2003-95645 w/English-language Translation.

Japanese Patent Office issued Feb. 22, 2011 in Japanese Patent Application No. 2009-102951 w/English-language Translation.

*Primary Examiner* — Bruce H Hess
(74) *Attorney, Agent, or Firm* — Oliff & Berridge, PLC

(57) ABSTRACT

There is provided a printing method that can provide an image formed object which can suppress a change in density of a visible dye image and a lowering in fluorescence intensity and, at the same time, is free from concave/convex of the image surface and has a latent image invisible even under visible light. The printing method comprises a first step of forming a latent image of a fluorescent dye by thermal diffusion transfer; and a second step of providing a visible dye on the latent image by thermal diffusion transfer.

3 Claims, 3 Drawing Sheets

PRINTING METHOD USING THERMAL DIFFUSION TRANSFER, AND IMAGE FORMED OBJECT

This is a Continuation of application Ser. No. 11/482,713, filed Jul. 10, 2006, which is a Continuation-in-Part of application Ser. No. 10/812,414, filed Mar. 30, 2004. The entire disclosure of the prior applications are hereby incorporated by reference in their entirety.

TECHNICAL FIELD

The present invention relates to an image formed object with a latent image, which is invisible under ordinary visible light, but on the other hand, is visible as a fluorescent image upon exposure to a radiation other than visible light, such as ultraviolet light, and a printing method for image formed object formation. More particularly, the present invention relates to an image formed object suitable for thermal transfer sheets and security elements, and a printing method for image formed object formation.

BACKGROUND ART

Images using both a visible dye and a fluorescent dye have hitherto been used as images that have a security measure such as for reproduction prevention purposes. An example of a conventional method for preparing this print is to form an image, by thermal diffusion transfer of visible dyes such as yellow dyes, magenta dyes, and cyan dyes, on which image a latent image is then formed by thermal ink transfer or thermal diffusion transfer of a fluorescent dye that emits fluorescence upon exposure to ultraviolet light.

When a latent image is provided by thermal ink transfer, however, concave/convex is present in the image although it is colorless. The concave/convex is visible under visible light without the application of ultraviolet light. Therefore, the image could not be said to be a completely latent image. Further, also when a protective layer is provided so as to cover the surface of the latent image, in some cases, the concave/convex of the image is visible under visible light, and it was difficult to form a completely latent image.

FIG. 1 is a diagram illustrating a conventional technique using such thermal ink transfer. When a fluorescent dye 15 is transferred by thermal ink transfer onto image receiving paper 11, onto which a yellow dye 12, a magenta dye 13, and a cyan dye 14 have been transferred, the fluorescent dye 15 part is raised. Therefore, due to the presence of a concave/convex part, even when a protective layer 16 is provided, a completely invisible image cannot be provided.

On the other hand, when a latent image is provided by thermal diffusion transfer, the problem of concave/convex of the image can be solved. In this case, however, upon exposure of the visible dyes to heat at the time of the transfer of the fluorescent dye, the visible dyes are disadvantageously transferred onto the fluorescent dye ink sheet (hereinafter referred to as "backtrap"). As a result, color of the visible dye image on its part where the latent image has been formed sometimes becomes partly light. Thus, when the color of the visible dye has become light, the pattern of the latent image is disadvantageously visible. Further, when the visible dyes and the fluorescent dye are present together, energy transfer between dyes occurs, leading to a problem of a lowering in or complete loss of fluorescence intensity of the fluorescent dye.

FIG. 2 is a schematic diagram illustrating the above conventional technique using thermal diffusion transfer. A yellow dye, a magenta dye, and a cyan dye as visible dyes are thermally transferred in that order on image receiving paper 21, and a fluorescent dye, is thermally transferred thereon. In this case, upon exposure to heat at the time of the thermal transfer of the fluorescent dye, a part of the visible dyes (22 to 24) is transferred onto a fluorescent dye ink ribbon 27 (a transferred part being indicated by 28). Further, when the visible dyes and the fluorescent dye are thermally transferred in this order, disadvantageously, the luminescence intensity of the fluorescent dye is extremely lowered. Although the reason for this has not been fully elucidated yet, it is believed that, since the fluorescent dye is transferred onto the layer in which the visible dyes such as the yellow dye, the magenta dye, and the cyan dye have already been diffused, substantially the entire part of the transferred fluorescent dye interacts with the visible dyes, whereby the fluorescence of the fluorescent dye disadvantageously becomes extinct. In FIG. 2, numeral 22 designates a region where the yellow dye is mainly present, numeral 23 a region where the yellow dye and the magenta dye are mainly present, numeral 24 a region where the yellow dye, the magenta dye, and the cyan dye are mainly present, and numeral 25 a region where the yellow dye, the magenta dye, the cyan dye, and the fluorescent dye are mainly present.

SUMMARY OF THE INVENTION

Accordingly, an object of the present invention is to provide a printing method that can provide an image formed object which can suppress a change in density of a visible dye image and a lowering in fluorescence intensity and, at the same time, is free from concave/convex of the image surface and has a latent image invisible even under visible light.

The printing method in a first embodiment of the present invention comprises a first step of forming a latent image of a fluorescent dye by thermal diffusion transfer; and a second step of providing a visible dye on the latent image by thermal diffusion transfer.

The printing method by thermal diffusion transfer in a second embodiment of the present invention comprises: a first step of forming an image of a visible dye by thermal diffusion transfer; a second step of transferring a dye-receptive layer on the image; and a third step of forming a latent image of a fluorescent dye on the dye-receptive layer by thermal diffusion transfer.

The image formed object in a first embodiment of the present invention comprises: a latent image of a fluorescent dye formed by thermal diffusion transfer; and an image of a visible dye formed by thermal diffusion transfer on the latent image.

The image formed object in a second embodiment of the present invention comprises: an image of a visible dye formed by thermal diffusion transfer; a dye-receptive layer provided on the visible dye image; and a latent image of a fluorescent dye formed by thermal diffusion transfer on the dye-receptive layer.

The visible dye is preferably selected from the group consisting of yellow dyes, magenta dyes, and cyan dyes. A protective layer may further be formed on the image formed by thermal transfer.

In a preferred embodiment of the present invention, there is provided a security element comprising the above image formed object.

In another embodiment of the present invention, there is provided an integral thermal diffusion transfer sheet suitable for use in the above printing method, comprising at least a fluorescent dye layer and visible dye layers that are arranged side-by-side on one side of a substrate sheet so that thermal diffusion transfer is carried out in the order of the fluorescent dye and the visible dye. In still another embodiment of the present invention, there is provided a thermal diffusion transfer sheet, comprising at least visible dye layers, a dye-receptive layer forming layer, and a fluorescent dye layer that are arranged side-by-side on one side of a substrate sheet so that thermal diffusion transfer is carried out in the order of the visible dye, the dye-receptive layer, and the fluorescent dye.

In a first embodiment of the present invention, a latent image free from concave/convex can be formed by forming an image using a fluorescent dye by thermal diffusion transfer. A lowering in density of the visible image caused by backtrap can be prevented by transferring a fluorescent dye before the transfer of the visible dyes. Further, the phenomenon in which the fluorescence emitted from the fluorescent dye is weakened or completely lost by the action of the visible dyes can be suppressed.

In a second embodiment of the present invention, the lowering in density of the image caused by backtrap at the time of the transfer of the fluorescent dye can be suppressed by transferring the dye-receptive layer after the transfer of the visible dyes. Further, the provision of a latent image of a fluorescent dye by thermal diffusion transfer on the dye-receptive layer can realize the formation of a latent image free from concave/convex of the image and free from extinction of fluorescence caused by coexistence of the fluorescent dye and the visible dye.

DETAILED DESCRIPTION OF THE INVENTION

1. Printing Method in First Embodiment

Figure 1:
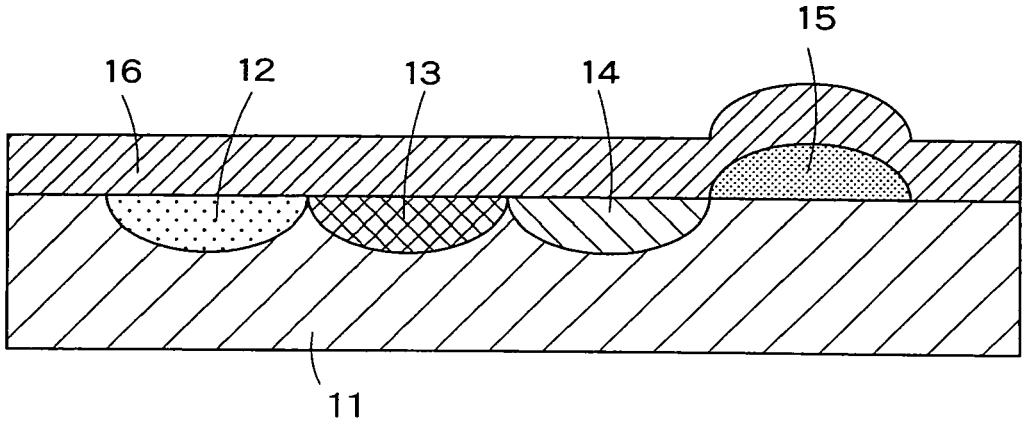
FIG. 1 is a diagram illustrating a conventional printing method using thermal ink transfer.
Figure 2:
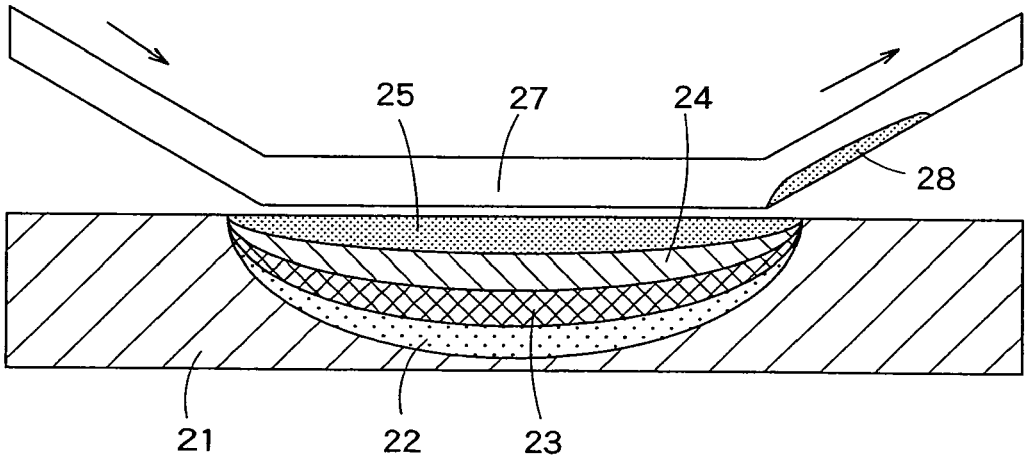
FIG. 2 is a diagram illustrating a conventional printing method using thermal diffusion transfer.
Figure 3:
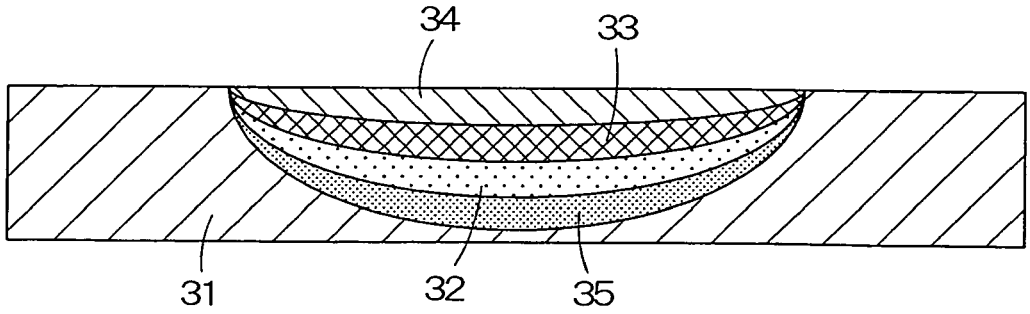
FIG. 3 is a diagram illustrating one embodiment of the printing method using thermal diffusion transfer according to the present invention.

FIG. 3 is a schematic diagram illustrating one embodiment of the printing method using thermal diffusion transfer according to the present invention. A fluorescent dye, a yellow dye, a magenta dye, and a cyan dye are successively transferred onto image receiving paper 31. In FIG. 3, numeral 32 designates a region where the fluorescent dye and the yellow dye are mainly present, numeral 33 a region where the fluorescent dye, the yellow dye, and the magenta dye are mainly present, numeral 34 a region where the fluorescent dye, the yellow dye, the magenta dye, and the cyan dye are mainly present, and numeral 35 a region where the fluorescent dye is mainly present.

In this case, since the fluorescent dye is first transferred, the backtrap of the visible dye at the time of the transfer of the fluorescent dye does not occur. Therefore, the density of the visible image is not lowered, and, thus, the invisibility of the latent image can be enhanced. Further, the lowering in fluorescence intensity can be suppressed (the lowering in fluorescence intensity can be significantly suppressed particularly in halftone of visible dyes). This effect is considered attributable to the presence of a region 35 where only the fluorescent dye is present and the visible dyes are absent.

Figure 4:
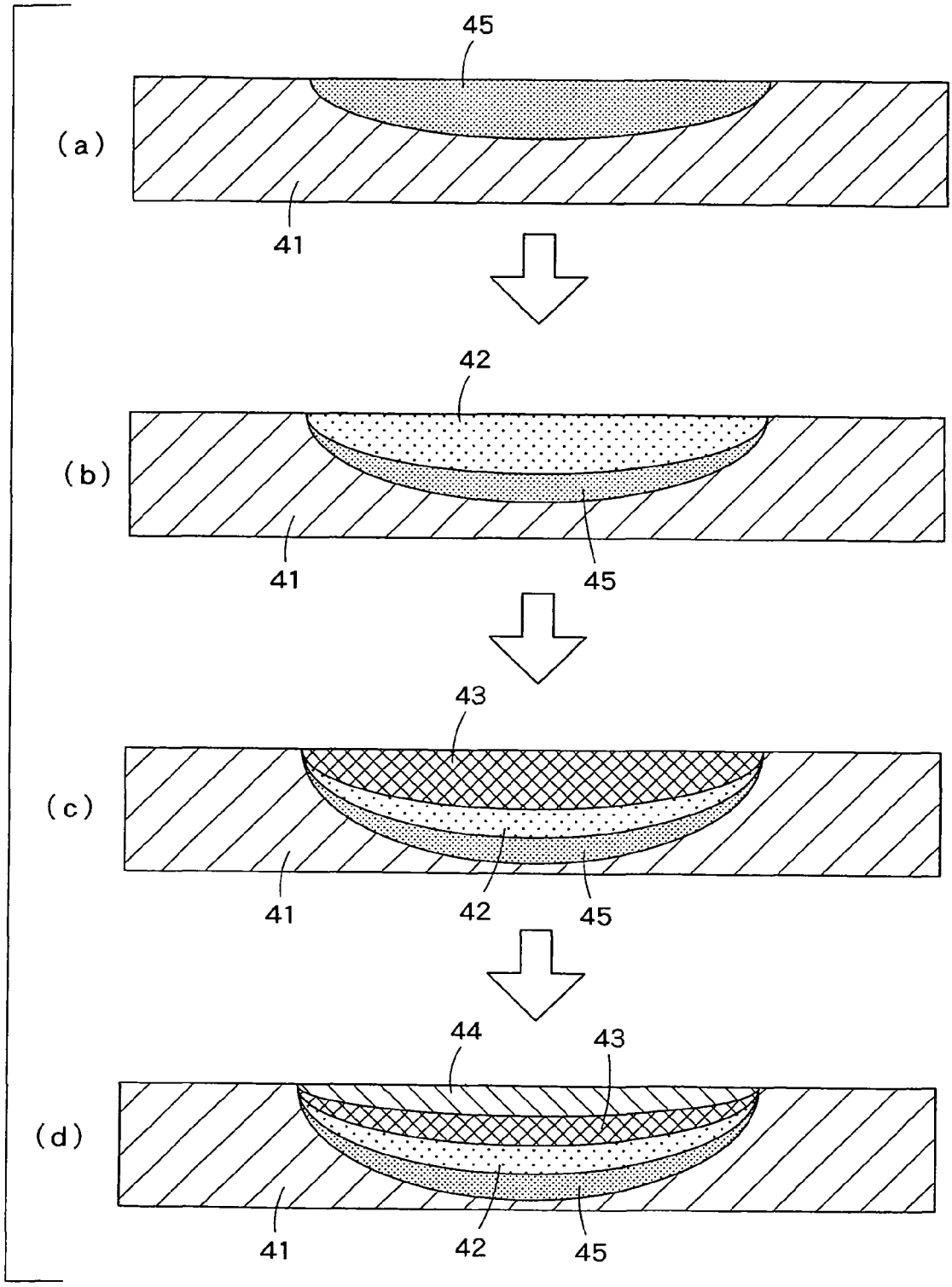
FIG. 4 is a diagram illustrating one embodiment of the procedure of the printing method using thermal diffusion transfer according to the present invention.

FIG. 4 is a schematic diagram illustrating one embodiment of the procedure of the printing method using thermal diffusion transfer according to the present invention, Here as shown in FIG. 4 (*a*), a fluorescent dye is first transferred onto image receiving paper 41. Next, as shown in FIG. 4 (*b*), a yellow dye is transferred. Further, as shown in FIG. 4 (*c*), a magenta dye is transferred, and, finally, as shown in FIG. 4 (*d*), a cyan dye is transferred. In FIG. 4, numeral 42 designates a region where the fluorescent dye and the yellow dye are mainly present, numeral 43 a region where the fluorescent dye, the yellow dye, and the magenta dye are mainly present, numeral 44 a region where the fluorescent dye, the yellow dye, the magenta dye, and the cyan dye are mainly present, and numeral 45 a region where the fluorescent dye is mainly present.

The above transfer procedure is considered to provide such a construction that a region 45 where the fluorescent dye has been mainly transferred, a region 42 where the yellow dye and the fluorescent dye have mainly been transferred and diffused and mixed together, a region 43 where the magenta dye, the yellow dye, and the fluorescent dye have mainly been transferred and diffused and mixed together, and a region 44 where the cyan dye, the magenta dye, the yellow dye, and the fluorescent dye have mainly been transferred and diffused and mixed together, are successively formed from the inner side of the image receiving paper.

2. Printing Method in Second Embodiment

Figure 5:
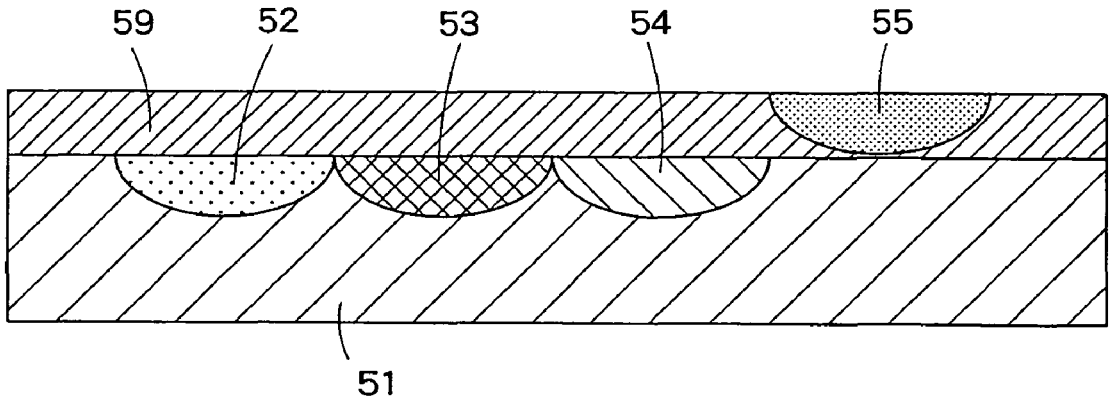
FIG. 5 is a diagram illustrating one embodiment of the printing method using thermal diffusion transfer and a dye-receptive layer according to the present invention.

FIG. 5 is a diagram illustrating one embodiment of a printing method using thermal diffusion transfer and a dye-receptive layer. In this embodiment, a yellow dye 52, a magenta dye 53, and a cyan dye 54 are transferred on image receiving paper 51. Thereafter, a dye-receptive layer 59 is transferred thereon, and a fluorescent dye 55 is further transferred onto the dye-receptive layer by thermal diffusion transfer. In this case, by virtue of the adoption of thermal diffusion transfer, the problem of concave/convex in the latent image of a fluorescent dye can be solved. Further, by virtue of the interposition of the dye-receptive layer 59, backtrap of the visible dye does not occur at the time of the transfer of the fluorescent dye and, thus, the density of the visible image is not lowered. Therefore, the invisibility of the latent image can be enhanced. Further, since the visible dye and the fluorescent dye are present in respective different layers, the lowering in fluorescence intensity can be suppressed.

Thermal Diffusion Transfer

In the present invention, an image is formed by thermal diffusion transfer. This thermal diffusion transfer is a transfer method known also as "diffusion transfer" or "sublimation dye transfer." Typically, in this method, a thermal diffusion transfer sheet is put on top of a printing face so that a dye layer in the thermal diffusion transfer sheet faces an image forming area in the printing face, and the dye layer is heated according to image information to be printed to thermally diffuse the dye into the printing face in its image forming area.

The amount of the dye transferred can be properly regulated by varying heating energy. When a combination of dyes having different colors is used, a variety of stepless color tones including white color can be properly formed. Further, in the transfer, any of a dot matrix method and superimposition printing may be carried out.

The use of the above thermal diffusion transfer method is advantageous in that concave/convex does not occur, the invisibility of the fluorescent dye is excellent, and the fact that printing has been made using the fluorescent dye is less likely to be found. Further, unlike other transfer methods, a laminate structure in which the dye is raised is not formed. Therefore, a lowering in scratch resistance can be suppressed.

Latent Image of Fluorescent Dye

In the present invention, a latent image (an image which is invisible under visible light, but on the other hand, is visible upon exposure to special light such as ultraviolet light) is formed of a fluorescent dye.

The fluorescent dye usable in the present invention is not particularly limited. For example, conventional organic and inorganic fluorescent dyes can be used. Among them, organic fluorescent dyes which are colorless in an ordinary state are preferred. Organic fluorescent dyes include EB-501, EG-502, and ER-120, manufactured by Mitsui Chemicals Inc.; EuN-0001, manufactured by Nippon Kayaku Co., Ltd.; Uvitex OB, manufactured by Ciba Specialty Chemicals, K.K.; colorless fluorescent colorants, manufactured by Sinloihi Co., Ltd.; and various fluorescent brightening agents. They may be used either solely or a combination of two or more.

Images include image pictures such as logs and character information and are not particularly limited.

Dye-Receptive Layer

The dye-receptive layer used in the present invention is not particularly limited so far as it is used in conventional prints. Examples of materials usable for the dye-receptive layer include: polyolefin resins such as polypropylene; halogenated polymers such as polyvinyl chloride, vinyl chloride-vinyl acetate copolymer, and polyvinylidene chloride; vinyl polymers such as polyvinyl acetate and polyacrylic ester; polyester resins such as polyethylene terephthalate and polybutylene terephthalate; polystyrene resins; polyamide resins; resins of copolymers of olefins such as ethylene or propylene with other vinyl monomers; ionomers; cellulose resins such as cellulose diacetate; and polycarbonates. Particularly preferred are vinyl resins and polyester resins.

Visible Dyes

The visible dye used in the present invention (the term "visible dye" as used herein referring to a conventional dye which is used in comparison with fluorescent dyes and exhibits substantially no noticeable fluorescent action) is not particularly limited and may be various conventional coloring matters and dye materials used in printing. The color tone is also not particularly limited. Typical color tones include yellow dyes, magenta dyes, and cyan dyes.

Examples of such visible dyes are as follows.

Yellow sublimable dyes include Forone Brilliant Yellow S-6GL (tradename of Disperse Yellow 231, manufactured by Sandoz K.K.) and Macrolex Yellow 6G (tradename of Disperse Yellow 201, manufactured by Bayer).

Magenta sublimable dyes include MS-RED G (tradename of Disperse Violet 26, manufactured by Bayer).

Cyan sublimable dyes include Kayaset Blue 714 (tradename of Solvent Blue 63, manufactured by Nippon Kayaku Co., Ltd.), Forone Brilliant Blue S-R (tradename of Disperse Blue 354, manufactured by Sandoz K.K.), and Waxoline AP-FW (tradename of Solvent Blue 36, manufactured by ICI).

Sublimable dyes of black color include mixtures of the above yellow, magenta, and cyan dyes.

Image Formed Object

The image formed object of the present invention is not limited so far as images or characters can be formed by printing. Typical examples thereof include printed papers, printed plastic cards, and printed outer packages of products, for example, ID cards and various certification documents. One preferred embodiment of the present invention is a security element to be printed or applied on an object of which the reproduction is to be prevented.

The image formed object according to the present invention may be used as a transfer layer in an intermediate transfer medium. That is, a method may also be adopted in which a latent image of a fluorescent dye is formed by thermal diffusion transfer on an intermediate transfer medium, visible dyes are then transferred by thermal diffusion transfer, and the assembly is retransferred onto an object.

Protective Layer

The protective layer usable in the present invention is not particularly limited so far as the protective layer can be used in conventional prints.

Further, in the present invention, additional provision of a protective layer on the latent image can enhance the invisibility of the latent image to such a level that the latent image is substantially invisible under visible light even by intentionally using a special identification method, for example, utilizing special reflection light.

The protective layer can be formed by coating a coating composition containing a resin for protective layer formation by conventional coating means onto the surface of a substrate. The protective layer is formed so as to have transparency on such a level that, after transfer of the protective layer, an image underlying the protective layer is seen through the protective layer, for example, so as to be colorless and transparent, or to be colored and transparent. Resins usable for protective layer formation include, for example, polyester resins, polystyrene resins, acrylic resins, polyurethane resins, acrylated urethane resins (either solely or as a mixture of two or more), modified resins produced by modifying the above resins with silicone, mixtures of these modified resins, ionizing radiation curing resins, and ultraviolet screening resins. The thickness of the protective layer is generally about 0.5 to 10 μm.

The protective layer containing the ionizing radiation curing resin is particularly excellent in plasticizer resistance and scratch resistance. The ionizing radiation curing resin may be a conventional ionizing radiation curing resin produced, for example, by crosslinking and curing a radically polymerizable polymer or oligomer (optionally with a photopolymerization initiator added thereto) by ionizing radiation (for example, electron beams or ultraviolet light).

The ultraviolet light screening resin can be contained in the protective layer so far as it is permeable to a major part of excitation light of the fluorescent dye. An example of this ultraviolet screening resin is one that is permeable to light with wavelengths around 366 nm and cut off light with shorter wavelengths. Such ultraviolet screening resins can impart lightfastness to prints.

The ultraviolet screening resin may be, for example, a resin produced by reacting a reactive ultraviolet absorber to a thermoplastic resin or the above ionizing radiation curing resin to bond the ultraviolet absorber to the resin. Reactive ultraviolet absorbers may be those produced by introducing a reactive group such as an addition polymerizable double bond (for example, a vinyl group, an acryloyl group, and a methacryloyl group), an alcoholic hydroxyl group, an amino group, a carboxyl group, an epoxy group, or an isocyanate group, into a nonreactive organic ultraviolet absorber such as a salicylate, benzophenone, benzotriazole, substituted acrylonitrile, nickel-chelate, or hindered amine nonreactive organic ultraviolet absorber.

A hologram pattern or the like may be formed in the protective layer. For example, a concave/convex pattern of a relief hologram may be mentioned as the hologram pattern.

Other patterns, for example, a concave/convex pattern of diffraction grating, may also be used.

Thermal Diffusion Transfer Sheet

The thermal diffusion transfer sheet in the first embodiment of the present invention is a fluorescent dye layer-visible dye layer integral thermal diffusion transfer sheet, comprising at least a fluorescent dye layer and visible dye layers that are arranged side-by-side on one side of a substrate sheet so that thermal diffusion transfer is carried out in the order of the fluorescent dye and the visible dyes. In this thermal diffusion transfer sheet, at least a fluorescent dye layer formed part provided on a substrate sheet and visible dye layer formed parts provided on a substrate sheet are provided in a patterned form on one sheet, that is, at least a fluorescent dye layer and visible dye layers are arranged in a face serial manner on one substrate sheet. This thermal diffusion transfer sheet can be used in the printing method according to the present invention by first heating the fluorescent dye layer part to conduct thermal diffusion transfer of the fluorescent dye layer and then heating the visible dye layer parts to conduct thermal diffusion transfer of the visible dye layers.

The thermal diffusion transfer sheet in the second embodiment of the present invention is a visible dye layer-dye-receptive layer forming layer-fluorescent dye layer integral thermal diffusion transfer sheet, comprising at least visible dye layers, a dye-receptive layer forming layer, and a fluorescent dye layer that are arranged side-by-side on one side of a substrate sheet so that thermal diffusion transfer is carried out in the order of the visible dyes, the dye-receptive layer, and the fluorescent dye. In this thermal diffusion transfer sheet, at least visible dye layer formed parts provided on a substrate sheet, a dye-receptive layer forming layer formed part provided on a substrate sheet, and a fluorescent dye layer formed part provided on a substrate sheet are provided in a pattern form on one sheet, that is, at least visible dye layers, a dye-receptive layer forming layer, and a fluorescent dye layer are arranged in a face serial manner on one substrate sheets. This thermal diffusion transfer sheet can be used in the printing method according to the present invention by first heating the visible dye layer parts to conduct thermal diffusion transfer, then heating the dye-receptive layer forming layer part to conduct thermal diffusion transfer, and further heating the fluorescent dye layer part to conduct thermal diffusion transfer.

Examples

The following Examples further illustrate the present invention, but are not intended to limit it.

Example A1

Visibility of Latent Image

An image formed object was prepared by a printing method using thermal diffusion transfer according to the present invention. A thermally diffusion-transferable fluorescent panel was used for the thermal diffusion transfer. The thermally diffusion-transferable fluorescent panel was produced as follows.

The thermally diffusion-transferable fluorescent panel had a three-layer structure of heat-resistant slip layer/easy-adhesion PET/thermally diffusion-transferable fluorescent color developing layer.

The heat-resistant slip layer was formed using the following materials by gravure coating onto the surface of a 6 μm-thick easy-adhesion PET film. The heat-resistant slip layer after drying had a thickness of 0.5 g/m$^2$.

| | |
|---|---|
| Polyvinyl butyral resin (S-lec BX-1, manufactured by Sekisui Chemical Co., Ltd.) | 3.6 pts. wt. |
| Polyisocyanate (Burnock D750, manufactured by Dainippon Ink and Chemicals, Inc.) | 8.6 pts. wt. |
| Phosphate surfactant (Plysurf A208S, manufactured by Dai-Ichi Kogyo Seiyaku Co., Ltd.) | 2.8 pts. wt. |
| Talc (Microace P-3, manufactured by Nippon Talc Co., Ltd.) | 0.7 pt. wt. |
| Methyl ethyl ketone | 32.0 pts. wt. |
| Toluene | 32.0 pts. wt. |

The thermally diffusion-transferable fluorescent color developing layer was formed using the following materials by gravure coating onto the surface of the easy-adhesion PET film remote from the heat-resistant slip layer. The thermally diffusion-transferable fluorescent color developing layer after drying had a thickness of 0.4 g/m$^2$.

| | |
|---|---|
| Oxazole fluorescent dye (UNITEX OB, manufactured by Ciba Specialty Chemicals, K.K.) | 1.5 pts. wt. |
| Polyvinyl acetoacetal resin (KS-5, manufactured by Sekisui Chemical Co., Ltd.) | 3.5 pts. wt. |
| Toluene | 47.5 pts. wt. |
| Methyl ethyl ketone | 47.5 pts. wt. |
| Polyethylene wax | 0.1 pt. wt. |

A latent image of a portrait image was transferred by thermal diffusion transfer using the thermally diffusion-transferable fluorescent panel onto a white polyvinyl chloride card to prepare image formed object A1. The thermal diffusion transfer energy was 0 (zero) to 0.21 mJ/dot according to the gradation.

A comparative image formed object was prepared by a conventional printing method using thermal ink transfer. A heat-fusion fluorescent panel was used for the thermal ink transfer. The heat-fusion fluorescent panel was prepared as follows.

The thermally ink-transferable fluorescent panel had a four-layer structure of heat-resistant slip layer/easy-adhesion PET/release layer/thermally ink-transferable fluorescent color developing layer.

In the same manner as described above, the heat-resistant slip layer was provided on the surface of the easy-adhesion PET film, and the release layer was formed using the following materials by gravure coating onto the surface of the easy-adhesion PET film remote from the heat-resistant slip layer. The release layer after drying had a thickness of 0.5 g/m$^2$.

| | |
|---|---|
| Polyvinyl alcohol resin | 2.0 pts. wt. |
| Urethane emulsion resin | 2.6 pts. wt. |
| Isopropyl alcohol | 63.6 pts. wt. |
| Ion-exchanged water | 31.8 pts. wt. |

Next, the thermally ink-transferable fluorescent color developing layer was formed using the following materials by gravure coating onto the upper surface of the release layer. The thermally ink-transferable fluorescent color developing layer after drying had a thickness of 1.0 g/m$^2$.

| | |
|---|---|
| Polyacrylic resin (BR-87, manufactured by Mitsubishi Rayon Co., Ltd.) | 27 pts. wt. |
| Oxazole fluorescent dye (UNITEX OB, manufactured by Ciba Specialty Chemicals, K.K.) | 1 pt. wt. |
| Toluene | 36 pts. wt. |
| Methyl ethyl ketone | 36 pts. wt. |

A latent image of a portrait image was transferred by thermal diffusion transfer using the thermally heat-fusion fluorescent panel onto a white polyvinyl chloride card to prepare image formed object A2. The thermal ink transfer energy was 0.18 mJ/dot.

For each of image formed objects A1 and A2 prepared above, a protective layer was provided. The protective layer was formed using the following materials by gravure coating onto the image formed surface. The protective layer after drying had a thickness of 1 g/m$^2$. Image formed object A1 provided with the protective layer was designated as "image formed object A3," and image formed object A2 provided with the protective layer was designated as "image formed object A4."

| | |
|---|---|
| Vinyl chloride-vinyl acetate copolymer resin (VY-LFX, manufactured by Union Carbide Corporation) | 30 pts. wt. |
| Toluene | 35 pts. wt. |
| Methyl ethyl ketone | 35 pts. wt. |

Each of image formed objects A1 to A4 prepared above was evaluated for the visibility of the latent image. The visibility was evaluated by exposing the image formed object to visible light and ultraviolet light to visually examine whether or not the portrait image is visible. The evaluation results were as shown in Table A1.

TABLE A1

| Transfer method | Protective layer | Under visible light | Under ultraviolet light (black light) |
|---|---|---|---|
| Thermal diffusion transfer | Provided | Invisible | Identifiable |
| | Not provided | Indentifiable by reflected light | Identifiable |
| Thermal ink transfer | Provided | Indentifiable by reflected light | Identifiable |
| | Not provided | Indentifiable by reflected light | Identifiable |

As is apparent from the results shown in Table A1, in image formed object prepared by thermal diffusion transfer (A3), a completely latent image, which, due to the provision of the protective layer as the surface layer, was invisible under visible light and was visible only under ultraviolet light, could be obtained. On the other hand, in the image formed objects prepared by thermal ink transfer (A2 and A3), independently of the provision of the protective layer, the latent image was visible even under visible light, that is, a completely latent image could not be obtained.

Example A2

Evaluation of Backtrap

Thermally diffusion-transferable fluorescent dye and yellow dye were transferred by thermal diffusion transfer in the order indicated in Table A2 below onto a white polyvinyl chloride card. The prints thus obtained were measured for reflection density (OD value) with a Macbeth reflection densitometer (RD-918 yellow filter). Further, the energy in the thermal diffusion transfer of the yellow dye was varied as shown in Table A2 below, and the same measurement as described above was carried out. The transfer energy of the thermally diffusion-transferable fluorescent dye was 0.18 mJ/dot. The results were as shown in Table A2.

TABLE A2

| | Yellow dye transfer energy (mJ/dot) | | |
|---|---|---|---|
| | 0.21 | 0.16 | 0.10 |
| Print formed by thermal diffusion transfer of yellow dye only | 2.14 | 1.14 | 0.24 |
| Print formed by thermal diffusion transfer of fluorescent dye and yellow dye in that order | 2.14 | 1.15 | 0.24 |
| Print formed by thermal diffusion transfer of yellow dye and fluorescent dye in that order | 2.03 | 0.91 | 0.23 |

As is apparent from the results shown in Table A2, in the case where the yellow dye was transferred after the transfer of the fluorescent dye, there was no lowering in yellow density relative to the case where only the yellow dye was transferred. On the other hand, in the case where the fluorescent dye was transferred after the transfer of the yellow dye, there was a lowering in yellow density due to the influence of backtrap.

Example A3

Evaluation of Fluorescence Intensity

Thermally diffusion-transferable fluorescent dye and yellow dye were transferred by thermal diffusion transfer in the order indicated in Table A3 below onto a white polyvinyl chloride card. The prints thus obtained were measured for relative fluorescence intensity with a spectrofluorometer (FP-6600, manufactured by Japan Spectroscopic Co., Ltd.). The thermally diffusion-transferable fluorescent dye transfer energy was 0.18 mJ/dot, and the yellow dye transfer energy was 0.10 mJ/dot. The results were as shown in Table A3.

TABLE A3

| | Relative fluorescence intensity |
|---|---|
| Print formed by thermal diffusion transfer of fluorescent dye only | 1.00 |
| Print formed by thermal diffusion transfer of fluorescent dye and yellow dye in that order | 0.52 |
| Print formed by thermal diffusion transfer of yellow dye and fluorescent dye in that order | 0.15 |

As is apparent from the results shown in Table A3, in the case where the yellow dye was transferred after the transfer of the fluorescent dye, the lowering in fluorescence intensity was suppressed as compared with the case where the fluorescent dye was transferred after the transfer of the yellow dye.

Example B1

Evaluation of Backtrap and Fluorescence Intensity

An image formed object was prepared by a printing method using a combination of the thermal diffusion transfer according to the present invention with a dye-receptive layer as follows.

A yellow dye was transferred by thermal diffusion transfer using a yellow dye panel onto the whole surface of a white polyvinyl chloride card, and a dye-receptive layer was transferred onto the whole surface thereof using a dye-receptive layer transfer panel which will be described later. Subsequently, a fluorescent dye was transferred by thermal diffusion transfer using the same thermally diffusion-transferable fluorescent panel as used in Example A1 to form a latent image. Thus, image formed object B1 was prepared. For all the yellow dye, the dye-receptive layer, and the fluorescent dye, the transfer energy was 0.18 mJ/dot.

The dye-receptive layer transfer panel had a five-layer structure of heat-resistant slip layer/easy-adhesion PET/release layer/dye-receptive layer forming layer/adhesive layer.

The heat-resistant slip layer was formed using the following materials by gravure coating onto the surface of a 6 μm-thick easy-adhesion PET film. The heat-resistant slip layer after drying had a thickness of 0.5 g/m$^2$.

| | |
|---|---|
| Polyvinyl butyral resin (S-lec BX-1, manufactured by Sekisui Chemical Co., Ltd.) | 3.6 pts. wt. |
| Polyisocyanate (Burnock D750, manufactured by Dainippon Ink and Chemicals, Inc.) | 8.6 pts. wt. |
| Phosphate surfactant (Plysurf A208S, manufactured by Dai-Ichi Kogyo Seiyaku Co., Ltd.) | 2.8 pts. wt. |
| Talc (Microace P-3, manufactured by Nippon Talc Co., Ltd.) | 0.7 pts. wt. |
| Methyl ethyl ketone | 32.0 pts. wt. |
| Toluene | 32.0 pts. wt. |

The release layer was formed using the following materials by gravure coating onto the upper surface of the easy-adhesion PET film remote from the heat-resistant slip layer. The release layer after drying had a thickness of 1.5 g/m$^2$.

| | |
|---|---|
| Acryl-styrene resin (CELTOP 226, manufactured by Daicel Chemical Industries, Ltd.) | 16 pts. wt. |
| Aluminum catalyst (CELTOP CAT-A, manufactured by Daicel Chemical Industries, Ltd.) | 3 pts. wt. |
| Toluene | 8 pts. wt. |
| Methyl ethyl ketone | 8 pts. wt. |

Next, the dye-receptive layer forming layer was formed using the following materials by gravure coating onto the surface of the release layer. The dye-receptive layer forming layer after drying had a thickness of 1.5 g/m$^2$.

| | |
|---|---|
| Vinyl chloride-vinyl acetate copolymer (# 1000AS, manufactured by Denki Kagaku Kogyo K.K.) | 100 pts. wt. |
| Amino-modified silicone (X-22-343, manufactured by The Shin-Etsu Chemical Co., Ltd.) | 5 pts. wt. |
| Epoxy-modified silicone (KF-393, manufactured by The Shin-Etsu Chemical Co., Ltd.) | 5 pts. wt. |
| Toluene | 250 pts. wt. |
| Methyl ethyl ketone | 250 pts. wt. |

The adhesive layer was then formed using the following materials by gravure coating onto the upper surface of the dye-receptive layer forming layer. The adhesive layer after drying had a thickness of 1.5 g/m$^2$.

| | |
|---|---|
| Ethylene-vinyl acetate copolymer resin heat sealant (AD-37 P295, manufactured by Toyo Morton Ltd.) | 100 pts. wt. |
| Ion-exchanged water | 100 pts. wt. |

A comparative image formed object was prepared by a conventional printing method using thermal diffusion transfer. A yellow dye was transferred by thermal diffusion transfer using the same yellow dye panel as used above onto the whole surface of a white polyvinyl chloride card, and a fluorescent dye was transferred by thermal diffusion transfer using the same thermally diffusion-transferable fluorescent panel as used above onto the whole surface thereof to form a latent image. Thus, image formed object B2 was prepared. Further, an image formed object in which only the yellow dye was transferred by thermal diffusion transfer (image formed object B3), and an image formed object in which only the fluorescent dye was transferred by thermal diffusion transfer (image formed object B4) were also prepared.

For all the yellow dye, the dye-receptive layer, and the fluorescent dye, the transfer energy was 0.18 mJ/dot.

Image formed objects B1 to B4 prepared above were measured for reflection density (OD value) with a Macbeth reflection densitometer (RD-918 yellow filter). Further, the relative fluorescence intensity was measured with a spectrofluorometer (FP-6600, manufactured by Japan Spectroscopic Co., Ltd.).

The results were as shown in Table B1.

TABLE B1

| | O. D value | Relative fluorescence intensity |
|---|---|---|
| Print formed by transfer of fluorescent dye only | — | 1.00 |
| Print formed by transfer of yellow dye only | 1.72 | — |
| Print formed by transfer of yellow dye, dye-receptive layer, and fluorescent dye in that order | 1.69 | 0.21 |
| Print formed by transfer of yellow dye and fluorescent dye in that order | 1.53 | 0.008 |

As is apparent from the results of Table B1, image formed object B1 had substantially no lowered yellow density relative to image formed object B3. On the other hand, for image formed object B2, a lowering in yellow density was observed due to the influence of backtrap. It is also apparent that, for image formed object B1, the level of lowering in fluorescence intensity was smaller than that for image formed object B2.

Example B2

Visibility of Latent Image

A protective layer was further provided on image formed object B1 prepared above. In this case, the protective layer was formed in the same manner as in Example A1.

A completely latent image, which is invisible under visible light and is visible only under ultraviolet light, could be realized by providing a protective layer as the surface layer of the image formed object.

What is claimed is:

1. A method for printing by thermal diffusion transfer, comprising:

a first step of forming an image of a visible dye by thermal diffusion transfer onto an image receiving layer;

a second step of transferring a dye-receptive layer on the image; and a third step of fowling a latent image of a fluorescent dye on the dye-receptive layer by thermal diffusion transfer.

2. The printing method according to claim 1, which further comprises a step of forming a protective layer on the image after the second step.

3. The printing method according to claim 1, wherein the latent image is free from concaves and convexes.

* * * * *